United States Patent [19]

Ives et al.

[11] Patent Number: 4,514,444

[45] Date of Patent: Apr. 30, 1985

[54] FABRIC CLEANING/CONDITIONING COMPOSITIONS

[75] Inventors: Donald T. Ives, Covington, Ky.; Michael J. Madill; Philip G. Sliva, both of Cincinnati, Ohio

[73] Assignee: The Procter & Gamble Company, Cincinnati, Ohio

[21] Appl. No.: 576,597

[22] Filed: Feb. 3, 1984

[51] Int. Cl.[3] ..... D06M 13/18; D06M 13/20; D06M 13/36; D06M 13/40

[52] U.S. Cl. ..... 427/242; 252/8.6; 252/8.75; 252/8.8; 252/8.9; 252/90; 252/140; 252/155; 252/174; 252/174.13; 252/174.21; 252/174.25; 252/179; 252/401; 252/403; 252/544; 252/546

[58] Field of Search ..... 252/8.8, 174.13, 8.6, 252/8.75, 8.9, 90, 155, 174.13, 174.21, 174.25, 179, 401, 403, 544, 546; 427/242

[56] References Cited

U.S. PATENT DOCUMENTS

| | | | |
|---|---|---|---|
| 3,442,692 | 5/1969 | Gaiser | 117/120 |
| 3,936,537 | 2/1976 | Baskerville, Jr. et al. | 427/242 |
| 4,013,574 | 3/1977 | Leikhim et al. | 252/174.13 |
| 4,022,938 | 5/1977 | Zaki et al. | 427/242 |
| 4,062,647 | 12/1977 | Storm et al. | 8/137 |
| 4,090,973 | 5/1978 | Maguire et al. | 252/174.13 |
| 4,237,155 | 12/1980 | Kardouche | 427/242 |
| 4,265,772 | 5/1981 | Jones | 252/8.6 |
| 4,292,035 | 9/1980 | Battrell | 8/137 |
| 4,308,151 | 12/1981 | Cambre | 252/8.8 |

FOREIGN PATENT DOCUMENTS

| | | |
|---|---|---|
| 1087352 | 10/1980 | Canada . |
| 0011340 | 5/1980 | European Pat. Off. . |

OTHER PUBLICATIONS

Fieser & Fieser, Organic Chemistry, 2nd Ed., Heath, Boston, United States, (1950), pp. 220–225.

*Primary Examiner*—Dennis L. Albrecht

*Attorney, Agent, or Firm*—William H. Gould; Thomas H. O'Flaherty; Richard C. Witte

[57] ABSTRACT

Fabric cleaning/conditioning compositions of improved stability are disclosed for use through-the-wash in conjunction with machine dryers. This is accomplished by incorporating a low level of polyethylene glycol into small, discrete amine salt nodules. These nodules pass virtually unchanged through the wash and rinse; become entangled in the fabrics when spun or wrung out; and then melt, spread, and condition the fabrics when heated in a dryer.

14 Claims, No Drawings

FABRIC CLEANING/CONDITIONING COMPOSITIONS

TECHNICAL FIELD

This invention relates to novel fabric cleaning/conditioning compositions which are especially useful in a laundry process that involves washing followed by drying in a machine dryer at elevated temperatures. Fabric cleaning is provided in the washer; and fabric conditioning, i.e. softening and destaticization, is provided principally in the dryer.

BACKGROUND ART

There have been a great many disclosures of compositions which, when used separately, provide detergency and fabric conditioning benefits. By fabric conditioning is meant improving softness, i.e. making its "handle" or texture more smooth, pliable and fluffy to the touch; and also reducing static "cling" in the fabrics, i.e. destaticizing. Perhaps the most common fabric conditioners known in the art are cationic compounds, especially quaternary ammonium and imidazolinium salts. These compounds are widely marketed for home use in the form of liquid emulsions. They must be added to the home laundry in the rinse cycle, not the wash, because cationic fabric conditioners interact with anionic substances present in the wash, such as anionic surfactants and builder salts, thereby rendering both relatively ineffective. A commercial fabric conditioner of this type is Downy ® The Procter & Gamble Company.

Another type of compound known for this purpose comprises certain tertiary amines, as disclosed in Kenyon, Canadian Pat. No. 1,087,352 issued Oct. 14, 1980 incorporated herein by reference. Clay as a fabric conditioning ingredient is disclosed in Storm et al, U.S. Pat. No. 4,062,647 issued Dec. 13, 1977, incorporated herein by reference.

Certain compositions are already known that provide fabrics with a detergency treatment in a washer combined with a degree of fabric conditioning treatment in a subsequent machine dryer. Compositions of this kind are known in the art as through-the-wash fabric conditioners, and are convenient to use in that they do not require the use of a second product in the rinse cycle or in the dryer to accomplish the fabric conditioning objective. Baskerville, Jr. and Schiro disclose in U.S. Pat. No. 3,936,537 issued on Feb. 3, 1976, incorporated herein by reference. a composition of this type wherein the fabric conditioning agents are quaternary ammonium compounds. A commercial cleaning/conditioning product which has utilized the teachings of Baskerville, Jr. et al is Bold-3 ® The Procter & Gamble Company.

Through-the-wash compositions utilizing a mixture of tertiary amines and clay as fabric conditioner are disclosed in Crisp et al, European Patent Publication No. 0,011,340 published May 28, 1980, incorporated herein by reference.

Battrell, in U.S. Pat. No. 4,292,035 issued Sept. 29, 1981, incorporated herein by reference, prepared through-the-wash compositions wherein fabric softening was accomplished by a complex of clay with certain nitrogen containing organic compounds defined as primary, secondary and tertiary amines and their water soluble or water dispersible salts and organic quaternary ammonium, phosphonium and sulfonium compounds.

Another means of providing fabric conditioning was disclosed in Gaiser, U.S. Pat. No. 3,442,692 issued May 6, 1969, incorporated herein by reference, as an article of manufacture comprising a fabric conditioning composition in conjunction with a dispensing means for use in a machine dryer. Preferred articles had the fabric conditioning composition releasably affixed to an absorbent substrate, such as a nonwoven tissue, in the form of an impregnate or coating of cationic fabric conditioning agent. The use of certain polyols, especially sorbitan esters, as auxiliary fabric conditioning agents in products of this kind is disclosed in Zaki et al, U.S. Pat. No. 4,022,938 issued May 10, 1977, incorporated herein by reference. A commercial product that has utilized the teachings of Gaiser and Zaki et al is Bounce ® The Procter & Gamble Company.

Fabric conditioning articles of the Gaiser type wherein the fabric conditioning composition was comprised of certain amine salts are disclosed by Kardouche in U.S. Pat. No. 4,237,155 issued Dec. 2, 1980, incorporated herein by reference. This patent alluded to the possibility of adding these amine salts to the wash cycle or to the rinse cycle of a typical washing operation, and apparently envisaged a softening process taking place during the one or the other of those two processes, respectively.

U.S. patent application Ser. No. 476,651 filed Mar. 18, 1983, now abandoned, invented by Kardouche and Giardina (incorporated herein by reference) discloses and claims a means of utilizing the benefits of amine salts in through-the-wash compositions. Specified amines and carboxylic acids were reacted together to form a melt, which was then chilled to produce discrete nodules. Among the nodulizing processes said to be suitable were prilling, flaking on a chill roll, and cooling in a scraped wall heat exchanger followed by extruding. These nodules were then mixed with conventional detergency and/or stain removal ingredients to make compositions which were added to laundry wash or rinse liquor; which remained trapped in the fabrics when wrung out or spun dry; and which distributed on the fabrics in a mechanical, heated drying process. The result was effectively softened and destaticized fabrics.

Clear distinctions between amines, amides, amine salts, quaternary ammonium salts, and other classes of nitrogen-containing chemical compounds appear in every textbook of organic chemistry. Fieser and Fieser in Organic Chemistry, 2nd Ed., Heath, Boston U.S.A. (1950) point out a number of such distinctions in chapter 10 beginning at page 220, incorporated herein by reference. Amine salts are characterized as typically odorless, nonvolatile solids, even though the amines from which they are derived are odoriferous gases or liquids. The salts are ionic in nature in the solid state, and possess characteristically sharp melting points which are higher than those of the corresponding amines. Low molecular weight amine salts are readily soluble in water and exist in the solution in ionized condition.

SUMMARIZED DISCLOSURE OF THE INVENTION

The nodules of Kardouche and Giardina are, when first prepared, highly effective fabric conditioners when used the manner taught in their patent application U.S. Ser. No. 476,651 referred to hereinbefore. However, it has been found that detergent compositions containing Kardouche/Giardina nodules do not condition fabrics so effectively after they have been stored for an extended period of time. It is clearly advantageous for a commercial product to remain stable for long periods under normal conditions in the trade. Accordingly, it is the purpose of this invention to improve upon the invention of Kardouche and Giardina by providing fabric conditioning nodules which remain more chemically stable when mixed with conventional detergency ingredients.

Storage stability is satisfactory for the Kardouche/-Giardina nodules when stored by themselves, i.e. with nothing else present. However storage stability is adversely affected when those nodules are blended with detergency ingredients to make through-the-wash fabric cleaning/fabric conditioning compositions. It has now been surprisingly and unexpectedly found that incorporating small amounts of polyethylene glycol into the nodules protects their storage stability under these circumstances.

One embodiment of this invention is a nodule comprising polyethylene glycol and a salt of a tertiary amine and a carboxylic acid. These nodules are suitable for marketing as a fabric conditioning agent to be added to a laundry wash liquor at the beginning of the cycle, along with a conventional detergent product. The particle size of these amine salt nodules is from about 0.03 to about 1 mm., and the melting point is preferably from about 35° to about 115° C.

The tertiary amine used to prepare the amine salt of this invention has the formula

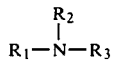

wherein $R_1$, $R_2$ and $R_3$ are each, independently, saturated or unsaturated and wherein $R_1$ is a long chain aliphatic group having from 12 to 22 carbon atoms and $R_2$ and $R_3$ are the same or different from each other and are selected from the group consisting of aliphatic groups containing from 1 to 22 carbon atoms, hydroxyalkyl groups of the formula $—R_4OH$ wherein $R_4$ is an alkylene group having from 1 to 3 carbon atoms, and alkyl ether groups having the formula $R_5O(C_nH_{2n}O)_m—$ wherein $R_5$ is hydrogen or an alkyl or alkenyl group having from 1 to 20 carbon atoms, n is 2 or 3, and m is from 1 to 20.

The carboxylic acid used to prepare the amine salt of this invention has the formula

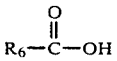

wherein $R_6$ is hydrogen, or an alkyl, alkenyl, aryl, alkaryl or aralkyl group having 1 to 22 carbon atoms, or a substituted alkyl, alkenyl, aryl, alkaryl, or aralkyl group having from 1 to 22 carbon atoms wherein the substituents are selected from the group consisting of halogen, carboxyl, or hydroxyl.

The amine salt is formed by reacting the amine and the carboxylic acid together to form a melt.

The polyethylene glycol useful in the practice of this invention has a molecular weight of from about 2000 to about 16,000 and is used in an amount from about 0.5% to about 16% based on the weight of the nodules.

Auxiliary components that do not interfere excessively with melting point or solubility can optionally be added to the nodules. Such components are both auxiliary fabric conditioning agents and fabric conditioning additives. They can be used in amounts up to about 50% by weight of the nodules.

The polyethylene glycol is added to the amine salt melt and the two immiscible liquids are well mixed and then chilled in a manner that produces discrete nodules. Suitable nodulizing processes are prilling, flaking on a chill roll, and cooling in a scraped wall heat exchanger followed by extruding.

A second embodiment of this invention is a through-the-wash fabric cleaning/fabric conditioning composition which comprises a blend of the nodules described supra with detergent granules containing a detergency builder and an anionic, nonionic, amphoteric or zwitterionic surfactant. A fabric cleaning/conditioning product makes possible a single laundry product that effectively combines the two functions, cleaning and conditioning. It is simple and convenient to use, and does not require adding anything to the laundry at a different time.

In its processing embodiment, this invention provides a process for conditioning fabrics which comprises the steps of (a) contacting the fabrics with an effective amount of amine salt in the abovedefined composition and in nodule form, and (b) subjecting the fabrics to a temperature within the range from about 40° C. to about 95° C. The nodules are preferably applied to the fabrics from an aqueous bath, more preferably a laundry wash or rinse liquor; and the fabrics are preferably caused to tumble in relative motion to each other while being subjected to the heat.

The amine salts of this invention exist in the form of ion pairs within discrete nodules. Their high and sharp melting points cause them to neither appreciably melt nor dissolve in the laundry baths at the mildly elevated temperatures and at the pH's normally encountered in the wash and in the rinse, respectively. Accordingly, the functions of the fabric conditioner, the surfactant, the builder and indeed all other ingredients are accomplished just as though the products were utilized independently.

DETAILED DESCRIPTION OF THE INVENTION

The components of this invention in its several embodiments are described individually as follows:

The Essential Fabric Conditioning Compounds

The fabric conditioning compounds essential to this invention are carboxylic acid salts of a tertiary amine which has at least one long aliphatic chain containing from about 12 to about 22 carbon atoms.

The tertiary amine salts are a direct product of the reaction between a tertiary amine and a carboxylic acid.

The tertiary amines utilized in the present invention have the formula

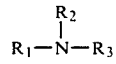

wherein $R_1$, $R_2$ and $R_3$ are each, independently, saturated or unsaturated and wherein $R_1$ is a long chain aliphatic group having from 12 to 22 carbon atoms and $R_2$ and $R_3$ are the same or different from each other and are selected from the group consisting of aliphatic groups containing from 1 to 22 carbon atoms, hydroxyalkyl groups of the formula —$R_4OH$ wherein $R_4$ is an alkylene group having 1 to 3 carbon atoms, and alkyl ether groups having the formula $R_5O(C_nH_{2n}O)_m$— wherein $R_5$ is hydrogen or an alkyl or alkenyl group having from 1 to 20 carbon atoms, n is 2 or 3, and m is from 1 to 20. Preferred amines are those wherein $R_1$ is an aliphatic alkyl chain having from 12 to 22 carbon atoms, $R_2$ is an aliphatic alkyl chain having from 12 to 22 carbon atoms, and $R_3$ is an aliphatic alkyl chain having from 1 to 3 carbon atoms. Especially preferred amines are those wherein $R_1$ and $R_2$ are each, independently, a saturated linear alkyl chain having from 16 to 18 carbon atoms, and $R_3$ is methyl.

Examples of specific tertiary amines are: lauryldimethylamine, myristyldiethylamine, stearyldimethylamine, tallowdimethylamine, coconutdimethylamine, dilaurylmethylamine, distearylmethylamine, ditallowmethylamine, oleyldimethylamine, dioleylpropylamine, lauryldi(3-hydroxypropyl)amine, stearyldi(2-hydroxyethyl)amine, trilaurylamine, laurylethylmethylamine, and

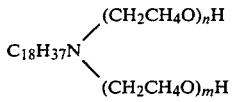

where (n+m)=20.

The carboxylic acids utilized in the present invention have the formula

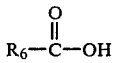

wherein $R_6$ is hydrogen, or an alkyl, alkenyl, aryl, alkaryl or aralkyl group having 1 to 22 carbon atoms, or a substituted alkyl, alkenyl, aryl, alkaryl, or aralkyl group having of from 1 to 22 carbon atoms wherein the substituents are selected from the group consisting of halogen, carboxyl, or hydroxyl. Preferred fatty acids are those wherein $R_6$ is a long chain, unsubstituted alkyl or alkenyl group having from 11 to 21 carbon atoms; more preferably a saturated linear alkyl group having from 15 to 17 carbon atoms.

Examples of specific carboxylic acids are: formic acid, acetic acid, lauric acid, myristic acid, palmitic acid, stearic acid, oleic acid, adipic acid, 12-hydroxy stearic acid, benzoic acid, 4-hydroxybenzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl)acetic acid, and phthalic acid.

Preferred carboxylic acids are lauric, myristic, palmitic, stearic, oleic and mixtures thereof.

The amine salt is formed by a simple addition reaction, well known in the art, whereby the tertiary amine is dissolved in a solvent such as methanol, ethanol, propanol, etc., and the acid is added to the amine solution. Alternatively, the amine and acid can simply be mixed and melted together with stirring to form the salt. The molten amine salt can then be solidified by cooling to room temperature. If the acid used to form the amine salt is a polybasic acid (e.g., oxalic acid), the salt can be monobasic or polybasic, i.e., either one or more of the acid groups can be utilized to neutralize the amine.

The formation of amine salts proceeds according to the following reaction:

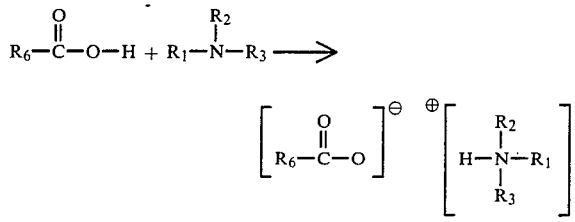

If the reaction is carried out in a lower alcohol solvent medium, the salt precipitates from solution, and can be recovered either by filtration and/or evaporation of the solvent. Preferably the amine and acid pair used in preparing amine salts of the present invention should be chosen so as to produce amine salts having a melting point somewhere within the range of from about 35° C. to 115° C. (more preferably 35° C. to 85° C.; most preferably 55°-65° C.). Such salts will be solid at room temperature but will melt at typical machine dryer operating temperatures. Amine salts having melting points higher than this range can be used in the present invention by formulating them into compositions which contain other materials as disclosed hereinafter so that the formulated composition has a melting point within the desired range.

A molar ratio of amine to fatty acid of about 1:1 results in the formation of the purest amine salt and the sharpest melting point. If ratios higher or lower than this are used, the end product of this reaction will contain the amine salt plus unreacted amine or unreacted carboxylic acid, respectively. These unreacted compounds affect the nodules in a similar manner as do the organic substances discussed in the section hereinafter which is entitled "Auxiliary Fabric Conditioning Agents and Additives". Accordingly the considerations involved in changing the molar ratio of amine to fatty acid are dealt with therein.

Preferred amine salts for use herein are those wherein the amine moiety is a $C_{12}$ to $C_{22}$ alkyl or alkenyl dimethyl amine or a di-$C_{12}$ to $C_{22}$ alkyl or alkenyl methyl amine, and the acid moiety is a $C_{12}$ to $C_{22}$ alkyl or alkenyl monocarboxylic acid. The amine and the acid, respectively, used to form the amine salt will often be of mixed chain lengths rather than single chain lengths, since these materials are normally derived from natural fats and oils, or synthetic processes which produce a mixture of chain lengths. Also, it is often desirable to utilize mixtures of different chain lengths in order to modify the physical or performance characteristics of the softening compositions.

An especially preferred amine salt is methylditallowamine hydrotallowate, where the term tallow refers to the mixture of alkyl moieties derived from tallow and the term tallowate refers to the mixture of fatty acid moieties derived from tallow. This compound can also be referred to as methylditallowammonium tallowate or sometimes as methylditallowamine tallowate. Other preferred amine salts for use in the present invention are stearyldimethylamine hydrostearate, stearyldimethylamine hydropalmitate, distearylmethylamine hydropalmitate, distearylmethylamine hydrolaurate, and mixtures thereof. A particularly preferred mixture is stearyldiemthylamine hydrostearate and distearylmethylamine hydromyristate.

The polyethylene glycol used in the practice of this invention is the well known compound $HO(CH_2CH_2O)_nH$ and has a molecular weight of from about 2000 to about 16,000, preferably from about 4000 to about 12,000. Especially preferred is a molecular weight from about 6000 to about 10,000.

The polyethylene glycol is melted and added to the amine salt melt which is prepared as described supra. These two immiscible liquids are well mixed to form an emulsion. High shear mixing can be used but is not necessary. While the emulsion continues to mix, it is cooled to form small, separate and discrete nodules. The term "nodule" is used generically herein to mean any discrete physical form that has been made by chilling from a melt. One process for making such nodules is prilling, e.g. in a tower. Another process is flaking on a chill roll. Still another method is based on cooling in a scraped wall heat exchanger and then extruding. Grinding or other comminuting processes can also be employed. It is also possible to produce very tiny particles in the manner described supra, and then form the nodules of this invention by a process involving agglomeration, pelletizing, briquetting, or the like. All these processes are conventional and well known in the art in relation to other materials.

Polyethylene glycol is used in the nodules in the amount of from about 0.5% to about 15%, preferably from about 1% to about 10%. Especially preferred is an amount from about 2% to about 5%, where all figures are given in weight percent based on the total weight of the nodules.

It is intended that the fabric conditioning agents function primarily in the dryer, and accordingly it is undesirable that they melt or dissolve to any great extent in the washer. Time, temperature and degree of agitation are not under the contrl of the product formulator, so nodules must be made that survive well over the entire range encountered in the real world of manual and automatic washing processes, soaking and pretreating, high and low temperature.

The fabric conditioning nodules, whether in the form of prills, flakes, noodles, or other discrete particles, are of such a size and composition that they become trapped, i.e. entangled in the clothes as discrete particles when spun or wrung out at the end of the rinse cycle. They remain with the fabrics when transferred to a mechanical drier; and then melt, spread, and condition the fabrics when heated to the working temperature of a mechanical dryer.

Configuration of the nodules also affects performance in the dryer. The larger nodules will tend to be entrapped by the outer surfaces of the fabrics, while the smaller nodules will penetrate further toward the inner fibers. Thus larger nodules tend to exert a stronger destaticizing effect, which is a fabric surface phenomenon; while smaller nodules tend to exert a stronger softening effect, which is in part a function of how individual fibers slide upon one another. Nodule penetration into the fabrics is very much affected by the geometry of the nodule as well as its size, decreasing in order from spheres to cylinders to plates (e.g. from prills to noodles to flakes). This provides another degree of freedom for the artisan to tailor make nodules to suit his particular purposes in the dryer as well as in the wash and rinse.

An approximation for the purpose of this invention is that the controlling dimension is the mean distance of the shortest paths from the central points of the nodules to the surface. Thus, for spheres or cylinders, this dimension is the radius; for ellipsoids, the minor radius; for plates, half the thickness of the plates. For convenience, the phrases nodule size and particle size as used herein will refer to twice this dimension; i.e. the diameter of spheres or cylinders, the thickness of plates, etc.

Using this definition of nodule size, sizes from about 0.03 to about 1 mm. are satisfactory; sizes from about 0.05 to about 0.6 mm. are preferred; and sizes from about 0.07 to about 0.3 mm. are especially preferred.

Auxiliary Fabric Conditioning Agents and Additives

The cleaning/conditioning compositions of this invention can be formulated with the fabric conditioning compounds discussed supra as the sole conditioning agents of the composition. Alternatively, however, it is possible to utilize other conditioning agents as well.

One class of auxiliary fabric conditioning agent is smectite clay. This mineral is disclosed in Storm et al, cited hereinbefore, as having both fabric softening and destaticizing properties. Clay particles carry through the washing rod rinsing cycles of a laundry process, became trapped in the fabrics, and are available to condition the fabrics after subsequent drying. Inasmuch as the mechanisms by which fabric are conditioned by amine salts and by clay are different, a skilled artisan is able to utilize both technologies to formulate a product to best meet his specific needs. In general terms, amine salt is a good softening agent and an especially good destaticizing agent, while clay is a good softening agent. A blend of the two utilizes these properties to great advantage and is a preferred composition. Suitable amounts of clay are within the range from about 1% to about 20% by weight of the composition, preferably from about 2% to about 12%.

As described in Storm et al, preferred smectite clays have a cation exchange capacity of at least 50 meq./100 gm. and can be sodium or calcium montmorillonites; lithium, sodium or magnesium saponites; or lithium, sodium or magnesium hectorites. Sodium montmorillonites are especially preferred, an example of which is Gelwhite GP® which is marketed by Georgia Kaolin Company.

A second class of auxiliary fabric conditioning agents is organic in nature. It includes cationic compounds such as quaternary ammonium compounds, quaternary imidazolinium compounds and polyamido quaternized biurets. Also included in this class are nonionic compounds such as protonated dipolyethoxy monoalkyl amine; $C_{10}$–$C_{26}$ fatty acid esters of mono- or polyhydroxy alcohols containing 1–12 carbon atoms, especially glycerol esters; sorbitan esters, especially sorbitan mono- and di-esters of $C_{12}$–$C_{20}$ fatty acids; and tertiary amines which have an iso-electric point from 8.3 to 9.8 and the structure $R_1R_2R_3N$ where $R_1$ is an alkyl group having from 1 to 6 carbon atoms and $R_2$ and $R_3$ are $C_{10}$–$C_{26}$ linear alkyl or alkenyl groups.

Another class of compounds that can be optionally added to the nodules influences the properties of the nodules but does not itself comprise fabric conditioning agents. Such compounds are herein referred to as fabric conditioning additives. Among materials of this kind are ethoxylated surfactants, fatty alcohols and acids, waxes, resins and solvents, excluding polyethylene glycol which is one of the essential elements of this invention. Fatty acid is a preferred additive.

As discussed hereinbefore, use of a molar excess of either the amine or the carboxylic acid used to synthesize the amine salts of this invention will result in unreacted amounts of whichever of these two ingredients is used in excess. The same general considerations apply to these unreacted ingredients that apply to the same ingredients when added separately, and apply to the cationic and nonionic conditioning agents and the conditioning additives discussed above.

The abovementioned auxiliary fabric conditioning agents and additives can be incorporated into either the fabric conditioning nodules or the detergent granules. The former is preferred, as through-the-wash conditioning performance is enhanced. However, in that form they should be employed in limited quantities, as they tend to increase the solibility, lower the melting point, and broaden the melting point range. When used in the nodules, they are sometimes referred to herein as auxiliary nodule components, and can be incorporated in the nodules in amounts up to about 50%, i.e. from 0 to about 50%, by weight of the nodules. When used, preferred amounts are from about 2% to about 30% by weight of the nodules.

Mathematically combining these figures with those given above for polythylene glycol usage, it is apparent that the amount of amine salt in the nodules of this invention can be from about 35% to about 99.5% by weight. Preferred amounts of amine salt in the nodules are from about 65% to about 96% by weight when auxiliary fabric conditioning agents and additives are used and from about 90% to about 99% by weight when these auxiliary materials are not used.

A person skilled in the art will recognize that compounds that are highly water soluble or have a melting point greatly different from the amine salts themselves will appreciably affect the properties of the nodules, and accordingly those compounds will be appropriate for use in relatively lower amounts than compounds that are less water soluble and have melting points closer to those of the amine salts. However, these auxiliaries can be useful because a suitable material can adjust physical properties into the desired range for an amine salt nodule whose chemical fabric conditioning properties are good but whose physical properties are not altogether satisfactory alone. This technique can be employed, for example, to use an amine salt that is a good softener but has too high a melting point when pure.

Detergent Granules

Surfactant. According to one embodiment of this invention there is utilized a surfactant selected from the group consisting of anionic, nonionic, ampholytic and zwitterionic detergents and mixtures thereof.

Preferred anionic non-soap surfactants are water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxyalkane-1-sulfonate, and beta-alkyloxy alkane sulfonate. Soaps are also preferred anionic surfactants.

Especially preferred alkyl benzene sulfonates have about 9 to about 15 carbon atoms in a linear or branched alkyl chain, more especially about 11 to about 13 carbon atoms. Especially preferred alkyl sulfate has about 8 to about 22 carbon atoms in the alkyl chain, more especially from about 12 to about 18 carbon atoms. Especially preferred alkyl polyethoxy ether sulfate has about 10 to about 18 carbon atoms in the alkyl chain and has an average of about 1 to about 12 —$CH_2CH_2O$— groups per molecule, especially about 10 to about 16 carbon atoms in the alkyl chain and an average of about 1 to about 6 —$CH_2CH_O$— *groups per molecule.*

Especially preferred paraffin sulfonates are essentially linear and contain from about 8 to about 24 carbon atoms, more especially from about 14 to about 18 carbon atoms. Especially preferred alpha-olefin sulfonate has about 10 to about 24 carbon atoms, more especially about 14 to about 16 carbon atoms; alpha-olefin sulfonates can be made by reaction with sulfur trioxide followed by neutralization under conditions such that any sultones present are hydrolyzed to the corresponding hydroxy alkane sulfonates. Especially preferred alpha-sulfocarboxylates contain from about 6 to about 20 carbon atoms; included herein are not only the salts of alpha-sulfonated fatty acids but also their esters made from alcohols containing about 1 to about 14 carbon atoms.

Especially preferred alkyl glyceryl ether sulfates are ethers of alcohols having about 10 to about 18 carbon atoms, more especially those derived from coconut oil and tallow. Especially preferred alkyl phenol polyethoxy ether sulfate has about 8 to about 12 carbon atoms in the alkyl chain and an average of about 1 to about 10 —$CH_2CH_2O$— groups per molecule. Especially preferred 2-acyloxy-alkane-1-sulfonates contain from about 2 to about 9 carbon atoms in the aryl group and about 9 to about 23 carbon atoms in the alkane moiety. Especially preferred beta-alkyloxy alkane sulfonate contains about 1 to about 3 carbon atoms in the alkly group and about 8 to about 20 carbon atoms in the alkyl moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal, ammonium, or alkanolammonium cations; sodium is preferred. Magensium and calcium are preferred cations under circumstances described by Belgian Pat. No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group and alkyl polyethoxy alcohol sulfate having 10 to 16 carbon atoms in the alkyl group and an average degree of ethoxylation of 1 to 6.

Especially preferred soaps contain about 8 to about 24 carbon atoms, more especially about 12 to about 18 carbon atoms. Soaps can be made by direct saponification of natural fats and oils such as coconut oil, tallow and fish oil, or by the neutralization of free fatty acids obtained from either natural or synthetic sources. The soap cation can be alkali metal, ammonium or alkanolammonium; sodium is preferred.

Preferred nonionic surfactants are water soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 mols of ethylene oxide with 1 mol of branched or straight chain, primary or secondary aliphatic alcohol having from about 8 to about 22 carbon atoms; more especially 1 to 6 mols of ethylene oxide condensed with 1 mol of straight or branched chain, primary or secondary aliphatic alcohol having from about 10 to about 16 carbon atoms; certain species of polyethoxy alcohols are commercially available from the Shell Chemical Company under the trade name "Neodol". Especially preferred polyethoxyl alkyl phenols are the condensation product of about 1 to about 30 mols of ethylene oxide with 1 mol of alkyl phenol having a branched or straight chain alkyl group containing about 6 to about 12 carbon atoms; certain species of polyethoxy alkyl phenols are commercially available from the GAF Corporation under the trade name "Igepal".

Especially preferred polyethoxy polypropoxy glycols are commercially available from BASF-Wyandotte under the trade nae "Pluronic". Especially preferred condensates of ethylene oxide with the reaction product of propylene oxide and ethylene diamine are commercially available from BASF-Wyandotte under the trade name "Tetronic".

Preferred semi-polar surfactants are water soluble amine oxides containing one alkyl moiety of from about 10 to 28 carbon atoms and 2 moieties selected from the group consisting of alkyl groups and hydroxyalkyl groups containing from 1 to about 3 carbon atoms, and especially alkyl dimethyl amine oxides wherein the alkyl group contains from about 11 to 16 carbon atoms; water soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water soluble sulfoxide detergents containing one alkyl moiety of from about 10 to 28 carbon atoms and a moiety selected from the group consisting of alkyl and hydroxyalkyl moieties of from 1 to 3 carbon atoms.

Preferred ampholytic surfactants are water soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Preferred zwitterionic surfactants are water soluble derivatives of aliphatic quaternary ammonium, phosphonium and sulfonium cationic compounds in which the aliphatic moieties can be straight chain or branched, and wherein one of the aliphatic substituents contains from about 8 to 18 carbon atoms and one contains an anionic water solubilizing group, especially alkyl-dimethyl-ammonio-propane-sulfonates and alkyl-dimethyl-ammonio-hydroxy-propane-sulfonates wherein the alkyl group in both types contains from about 14 to 18 carbon atoms.

A typical listing of the classes and species of surfactants useful in this invention appear in U.S. Pat. No. 3,664,961 issued to Norris on May 23, 1972 and hereby incorporated herein by reference. This listing, and the foregoing recitation of specific surfactant compounds and mixtures which can be used in the instant compositions, are representative of such materials but are not intended to be limiting.

Detergency Builder. According to one embodiment of this invention, there is utilized a detergent builder selected from among any of the conventional inorganic and organic water soluble builder salts as well as various water-insoluble builders. The water-soluble builder salts serve to control the pH of laundry solutions. Furthermore, builders enhance the fabric cleaning performance of the overall detergent compositions while at the same time they serve to suspend particulate soil released from the surface of the fabrics and prevent its redeposition on the fabric surfaces. Additionally, in certain compositions that contain certain smectite clays as fabric softening agents, polyanionic builder salts cause these clays to be readily and homogeneously dispersed throughout the aqueous laundering medium with a minimum of agitation. The homogeneity of the clay dispersion is necessary for the clay to function effectively as a fabric softener, while the ready dispersability allows granular detergent compositions to be formulated.

Included within the term detergency builder as used herein are inorganic and organic peroxy bleaches. By inorganic peroxy bleaches are meant inorganic peroxyhydrates; examples are alkali metal salts of perborates, percarbonates, persulfates, persilicates, perphosphates, and perpolyphosphates.

Preferred inorganic peroxy bleaches are the sodium and potassium salts of perborate monohydrate and perborate tetrahydrate. Sodium perborate tetrahydrate is especially preferred.

By organic peroxy bleach is meant urea peroxide $CO(NH_2)_2.H_2O_2$ or an organic peroxy acid or anhydride or salt thereof which has the general formula $$HO-O-\overset{\overset{\displaystyle O}{\|}}{C}-R-Y$$

wherein R is an alkylene group containing from 1 to about 20 carbon atoms, preferably 7 to 16 carbon atoms, or a phenylene group and Y is hydrogen, halogen, alkyl, aryl or any group which provides an anionic moiety in aqueous solution. Preferred organic peroxyacid compounds are diperdodecanedioic acid and diperazelaic acid.

With inorganic peroxy bleaches, a peroxy bleach activator can optionally be used. By this term is meant an organic peracid precursor containing one or more acyl groups which is susceptible to perhydrolysis. One preferred peroxy bleach activator is $C_7$–$C_9$ acyl oxybenzene sulfonate.

Non-limiting examples of suitable water-soluble, inorganic alkaline detergent builder salts include alkali metal carbonates, borates, phosphates, polyphosphates, bicarbonates and silicates. Specific examples of such salts are sodium and potassium tetraborates, perborates, bicarbonates, carbonates, tripolyphosphates, pyrophosphates, orthophosphates, and hexametaphosphates.

Examples of suitable organic alkaline detergency builder salts are: (1) Water-soluble aminopolycarboxylates, e.g. sodium and potassium ethylenediaminetetraacetates, nitrilotriacetates and N-(2-hydroxyethyl)-nitrilodiacetates; (2) Water-soluble salts of phytic acid, e.g., sodium and potassium phytates—see U.S. Pat. No. 2,739,942; (3) Water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) Water-soluble salts of polycarboxylate polymers and copolymers as described in U.S. Pat. No. 3,308,067.

In addition, other polycarboxylate builders which can be used satisfactorily include water soluble salts of mellitic acid, citric acid, pyromellitic acid, benzene pentacarboxylic acid, oxydiacetic acid, carboxymethyloxy-succinic acid and oxydisuccinic acid.

Certain zeolites or aluminosilicates enhance the function of the alkaline metal pyrophosphate and add building capacity in that the aluminosilicates sequester calcium hardness. One such aluminosilicate which is useful in the compositions of the invention is a crystalline water-insoluble hydrated compound of the formula $Na_z[AlO_2)_z.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from 0.1 micron to about 100 microns, preferably 1-10 microns; a calcium ion exchange capacity on an anhydrous basis of at least about 200 milligrams equivalent of $CaCO_3$ hardness per gram; and a calcium ion exchange rate on an anhydrous basis of at least about 2 grains/gallon/minute/gram. These synthetic aluminosilicates are more fully described in British Pat. No. 1,429,143 invented by Corkill et al, published Mar. 24, 1976, herein incorporated by reference.

A second water-insoluble synthetic aluminosilicate ion exchange material useful herein is amorphous in nature and has the formula $Na_x(xAlO_2.SiO_2)$, wherein x is a number from 1.0 to 1.2 and y is 1, said amorphous material being further characterized by a $Mg^{++}$ exchange capacity of from about 50 mg eq. $CaCO_3$/g. to about 150 mg eq. $CaCO_3$/g, and a particle diameter of from about 0.01 microns to about 5 microns. This ion exchange builder is more fully described in British Pat. No. 1,470,250 invented by B. H. Gedge et al, published Apr. 14, 1977, herein incorporated by reference.

Optional Ingredients. It is to be understood that the detergent granule portion of fabric cleaning/conditioning compositions of the present invention can contain other components commonly used in detergent compositions. Soil suspending agents such as water-soluble salts of carboxymethylcellulose, carboxyhydroxymethylcellulose, copolymers of maleic anhydride and vinyl ethers, polyacrylic acid and salts thereof, and polyethylene glycols having a molecular weight of about 400 to 10,000 are common components of detergent compositions and can be used at levels of about 0.5% to about 10% by weight. Dyes, pigments, optical brighteners, and perfumes can be added in varying amounts as desired.

Other materials such as enzymes, fluorescers, porphine bleach, antiseptics, germicides, anti-tarnish agents, anticorrosion agents, and anti-caking agents such as sodium sulfosuccinate and sodium benzoate may also be added. Other materials used in detergent compositions that can be used herein are suds boosters, suds depressants, fillers such as sodium sulfate, pH buffers, and hydrotropes such as sodium toluene sulfonate and urea.

Other optional materials are related to fabric conditioning: finishing agents, sizing agents, and anti-wrinkling agents such as corn starch which is disclosed in Belgian Pat. No. 811,082 issued Aug. 16, 1974, incorporated herein by reference.

Processes of Manufacture and Use

The nodules of the instant invention are prepared by the processes described hereinbefore. In one embodiment of this invention, they are marketed in this form as a fabric conditioning agent without further processing. They are used by simply adding to the beginning of the wash at the same time as detergent is added; the user is then relieved of the need to add additional materials to the laundry at any later stage of the washing, rinsing and mechanical drying cycle. A suitable amount of nodules in undiluted form to be added to a home washer handling 8 pounds of clothes is in the range of 1 to 20 grams.

For convenience in dispensing or for other reasons it may be desired to admix some other substance in discrete particular form to the nodules before packaging. A skilled formulator is free to select the amount and type of diluent from among substances that are inert, cheap, convenient, safe and available.

In another embodiment of this invention, the nodules are admixed by proportionation, batch or continuous, with detergent granules. This provides a through-the-wash fabric cleaning/fabric conditioning composition that accomplishes multiple functions in a single product.

The detergent granules can be formed by any of the conventional techniques i.e., by slurrying the individual components in water and then atomizing and spray-drying the resultant mixture, or by pan or drum granulation of the components. A preferred method of spray drying compositions in granule form is disclosed in U.S. Pat. Nos. 3,629,951 and 3,629,955 issued to Davis et al on Dec. 28, 1971, both incorporated herein by reference.

The fabric cleaning/fabric conditioning compositions of this invention contain an anionic, nonionic, ampholytic or zwitterionic surfactant, preferably anionic; a detergency builder; and an amine salt fabric conditioning agent in nodular form as defined herein. Preferably the surfactant is from about 1% to about 50% by weight of the composition, more preferably from about 5 to about 30%, most preferably from 10 to 20%. Preferably the detergency builder is from about 5% to about 95% by weight of the composition, preferably from about 10% to about 60%, most preferably from 15 to 40%. Preferably the fabric conditioning agent is from about 1 to about 30% by weight of the composition, preferably from about 3 to about 20%, most preferably from 5 to 15%.

The fabric cleaning/fabric conditioning compositions of this invention can also, optionally, contain other additives as described herein in the section entitled Optional Ingredients. These additives can be incorporated into the detergent granules or, optionally, they can be prepared in the form of finely divided, particulate, water soluble or water dispersable components. In this event, the fabric conditioning nodules, the particulate additives, and the detergent granules are all blended by proportionation to form the final product.

The pH of the fabric cleaning/conditioning compositions of this invention is controlled in the manner that is customary for detergent compositions. Accordingly, the pH of 1% aqueous solutions of the fabric cleaning/conditioning compositions is preferably from about 8 to about 12, with 9-11 especially preferred.

Each of the embodiments of the invention is intended to be used in a laundry process comprising washing, rinsing and drying. The washing step can be by hand or in a machine, manual or automatic. Soaking is optional. Rinsing can also be by hand or by machine, wrung out or spun to remove excess water. Although drying can be accomplished without difficulty by hanging on a line or spreading out in the sun, the fabric conditioning benefits of this invention are more pronounced when drying takes place in a mechanical dryer. Sometimes referred to as an automatic dryer, such a device tumbles the clothes with hot air, usually at a temperature of from about 40 to about 95° C., most often at temperatures of 50°-95° C. The amine salt nodules of this invention, which are entangled in the clothes leaving the rinsing step, thereupon soften or melt, spreading upon the fabric surfaces to destaticize them and penetrating toward the inner fibers thereof to soften them.

INDUSTRIAL APPLICATION

The formulation and processing of this invention are carried out as follows. Flakes of hydrogenated tallow fatty acid (mol. wt. 274) in the amount of 1370 grams; chunks of di(hydrogenated tallow)methyl amine (mol. wt. 520) in the amount of 2600 grams; and flakes of polyethylene glycol having a molecular weight of 8000 in the amount of 120 grams are separately heated and melted in stainless steel vessels. The fatty acid and amine are then blended together and agitated for 10 minutes, which results in formation of the amine salt. The polyethylene glycol is added to the molten amine salt and agitated an additional 10 minutes. With this continuing agitation, this melt is prilled by atomizing with air in a two fluid nozzle and dropping through a cold-air tower. These prills are stored for varying periods of time at temperatures between 25° C. and 50° C.

Detergent granules are prepared by crutching and spray-drying ingredients in a conventional manner, resulting in the following composition: 15% $C_{13}$ linear alkyl benzene sulfonate; 20% sodium tripolyphosphate; 10% sodium carbonate, 2% sodium silicate solids (1.6 mol ratio $5{:}O_2/Na_2O$); 1% sodium toluene sulfonate, 6% water, and the balance sodium sulfate.

The prills described above, before and after storage, are blended with the detergent granules in the ratio 13:87 to produce finished products. These finished products will provide good fabric conditioning performance, whether tested immediately or after they in turn are stored for extended periods of time at the temperatures mentioned above. Previous work with amine salt prills not containing polyethylene glycol, when blended with similar detergent granules, yielded finished product which showed reduced fabric conditioning performance after storage.

What is claimed is:

1. Fabric conditioning nodules which comprise:

(a) a fabric conditioning agent comprising a salt of (i) a tertiary amine having the formula

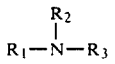

wherein $R_1$, $R_2$ and $R_3$ are each, independently, saturated or unsaturated and wherein $R_1$ is a long chain aliphatic group having from 12 to 22 carbon atoms and $R_2$ and $R_3$ are the same or different from each other and are selected from the group consisting of aliphatic groups containing from 1 to 22 carbon atoms, hydroxyalkyl groups of the formula $-R_4OH$ wherein $R_4$ is an alkylene group having from 1 to 3 carbon atoms, and alkyl ether groups having the formula $R_5O(C_nH_{2n}O)_m$—wherein $R_5$ is hydrogen or an alkyl or alkenyl group having from 1 to 20 carbon atoms, n is 2 or 3, and m is from 1 to 20; and (ii) a carboxylic acid having the formula

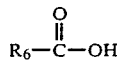

wherein $R_6$ is hydrogen, or an alkyl, alkenyl, aryl, alkaryl or aralkyl group having 1 to 22 carbon atoms, or a substituted alkyl, alkenyl, aryl, alkaryl, or aralkyl group having from 1 to 22 carbon atoms wherein the substituents are selected from the group consisting of halogen, carboxyl, and hydroxyl; and (b) from about 0.5% to about 15% by weight based on the weight of the fabric conditioning nodules of polyethylene glycol having a molecular weight from about 2000 to about 16,000;

wherein the particle size of said nodules is from about 0.03 mm. to about 1 mm.

2. Fabric conditioning nodules according to claim 1 wherein the amine salt is from about 35% to about 99.5% by weight of the nodules; wherein the polyethylene glycol has a molecular weight of from about 4,000 to about 12,000 and is from about 1% to about 10% by weight of the nodules; wherein the balance of the nodules is comprised of auxiliary fabric conditioning agents and additives; and wherein the melting point of the nodules is from about 35° C., to about 115° C.

3. Fabric conditioning nodules according to claim wherein the amine salt is from 90% to 99% by weight of the nodules and wherein $R_1$ and $R_2$ are each, independently, a saturated linear alkyl chain having from 16 to 18 carbon atoms; $R_3$ is methyl; and $R_6$ is saturated linear alkyl chain having from 15 to 17 carbon atoms; wherein the polyethylene glycol has a molecular weight of from 4,000 to 12,000 and is from 2% to 5% of the nodules; wherein the melting point of the nodules is from about 35° C. to about 85° C.; and wherein the particle size of the nodules is from 0.07 mm. to 0.2 mm.

4. A fabric cleaning/conditioning composition which comprises:

(a) fabric conditioning nodules according to claim 1 and (b) detergent granules comprising (i) an anionic, nonionic, amphoteric or zwitterionic surfactant; and (ii) a detergency builder.

5. A fabric cleaning/conditioning composition which comprises:

(a) fabric conditioning nodules according to claim 3 and (b) detergent granules comprising (i) an anionic, nonionic, amphoteric or zwitterionic surfactant; and (ii) a detergency builder.

6. A fabric cleaning/conditioning composition which comprises:

(a) fabric conditioning nodules according to claim 1, wherein the amount of amine salt is from about 1% to about 30% by weight of the composition; and (b) detergent granules comprising (i) from about 1% to about 50% by weight of the composition of an anionic, nonionic, amphoteric or zwitterionic surfactant;

(ii) from about 5% to about 95%, by weight of the composition of an inorganic or organic water soluble builder or an aluminosilicate builder; and (iii) from 0 to about 20% by weight of the composition of a smectite clay which has a cation exchange capacity of at least 50 meq./100 gm. and is selected from the group consisting of sodium and calcium montmorillonites; lithium, sodium and magnesium saponites; and lithium, sodium and magnesium hectorites.

7. A fabric cleaning/conditioning composition which comprises:

(a) fabric conditioning nodules according to claim 2, wherein the amount of amine salt is from about 1% to about 30% by weight of the composition; and (b) detergent granules comprising (i) from about 1% to about 50% by weight of the composition of an anionic, nonionic, amphoteric or zwitterionic surfactant;

(ii) from about 5% to about 95%, by weight of the composition of an inorganic or organic water soluble builder or an aluminosilicate builder; and (iii) from 0 to about 20% by weight of the composition of a smectite clay which has a cation exchange capacity of at least 50 meq./100 gm. and is selected from the group consisting of sodium and calcium montmorillonites; lithium, sodium and magnesium saponites; and lithium, sodium and magnesium hectorites.

8. A fabric cleaning/conditioning composition which comprises:

(a) fabric conditioning nodules according to claim 3, wherein the amount of amine salt is from about 1% to about 30% by weight of the composition; and (b) detergent granules comprising (i) from about 1% to about 50% by weight of the composition of an anionic, nonionic, amphoteric or zwitterionic surfactant;

(ii) from about 5% to about 95%, by weight of the composition of an inorganic or organic water soluble builder or an aluminosilicate builder; and (iii) from 0 to about 20% by weight of the composition of a smectite clay which has a cation exchange capacity of at least 50 meq./100 gm. and is selected from the group consisting of sodium and calcium montmorillonites; lithium, sodium and magnesium saponites; and lithium, sodium and magnesium hectorites.

9. A fabric cleaning/conditioning composition which comprises:

(a) fabric conditioning nodules according to claim 1 wherein the amount of amine salt is from 3% to 20% of the composition; and (b) detergent granules comprising:

(i) from 5% to 30% by weight of the composition of surfactant selected from the group consisting of water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate and soaps; water soluble compounds produced by the condensation of ethylene oxide with a hydrophobic compound such as an alcohol, alkyl phenol, polypropoxy glycol, or polypropoxy ethylene diamine; water soluble amine oxides, water soluble phosphine oxide detergents, and water soluble sulfoxide detergents; water soluble derivatives of aliphatic secondary and tertiary amines in which the aliphatic moiety can be straight chain or branched and wherein one of the aliphatic substituents contains from about 8 to about 18 carbon atoms and one contains a carboxy, sulfonate, sulfate, phosphate, or phosphonate group; and water soluble derivatives of aliphatic quaternary ammonium, phosphonium and sulfonium cationic compounds; and (ii) from 10% to 60% by weight of the composition of detergency builder selected from the group consisting of alkali metal carbonates, borates, phosphates, polyphosphates, bicarbonates and silicates; water-soluble aminopolycarboxylates, water-soluble salts of phytic acid, water-soluble polyphosphonates, water-soluble salts of polycarboxylate polymers and copolymers, mellitic acid, citric acid, pyromellitic acid, benzene pentacarboxylic acid, oxydiacetic acid, carboxymethyloxy-succinic acid, oxydisuccinic acid, and crystalline and amorphous sodium aluminosilicates.

10. A fabric cleaning/conditioning composition which comprises:

(a) fabric conditioning nodules according to claim 3 wherein the amount of amine salt is from 3% to 20% of the composition; and (b) detergent granules comprising:

(i) from 5% to 30% by weight of the composition of surfactant selected from the group consisting of water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate and soaps; water soluble compounds produced by the condensation of ethylene oxide with a hydrophobic compound such as an alcohol, alkyl phenol, polypropoxy glycol, or polypropoxy ethylene diamine; water soluble amine oxides, water soluble phosphine oxide detergents, and water soluble sulfoxide detergents; water soluble derivatives of aliphatic secondary and tertiary amines in which the aliphatic moiety can be straight chain or branched and wherein one of the aliphatic substituents contains from about 8 to about 18 carbon atoms and one contains a carboxy, sulfonate, sulfate, phosphate, or phosphonate group; and water soluble derivatives of aliphatic quaternary ammonium, phosphonium and sulfonium cationic compounds; and (ii) from 10% to 60% by weight of the composition of detergency builder selected from the group consisting of alkali metal carbonates, borates, phosphates, polyphosphates, bicarbonates and silicates; water-soluble aminopolycarboxylates, water-soluble salts of phytic acid, water-soluble polyphosphonates, water-soluble salts of polycarboxylate polymers and copolymers, mellitic acid, citric acid, pyromellitic acid, benzene pentacarboxylic acid, oxydiacetic acid, carboxymethyloxy-succinic acid, oxydisuccinic acid, and crystalline and amorphous sodium aluminosilicates.

11. A fabric cleaning/conditioning composition which comprises:

(a) fabric conditioning nodules according to claim 1 wherein the amount of amine salt is from 3% to 20% of the composition; and (b) detergent granules comprising:

(i) from 5% to 30% by weight of the composition of surfactant selected from the group consisting of water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate and soaps; and (ii) from 10% to 60% by weight of the composition of detergency builder selected from the group consisting of alkali metal carbonates, borates, phosphates, polyphosphates, bicarbonates and silicates; water-soluble aminopolycarboxylates, water-soluble polyphosphonates, water-soluble salts of polycarboxylate polymers and copolymers, citric acid, and crystalline and amorphous sodium aluminosilicates.

12. A fabric cleaning/conditioning composition which comprises:

(a) fabric conditioning nodules according to claim 3 wherein the amount of amine salt is from 3% to 20% of the composition; and (b) detergent granules comprising:

(i) from 5% to 30% by weight of the composition of surfactant selected from the group consisting of water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate and soaps; and (ii) from 10% to 60% by weight of the composition of detergency builder selected from the group consisting of alkali metal carbonates, borates, phosphates, polyphosphates, bicarbonates and silicates; water-soluble aminopolycarboxylates, water-soluble polyphosphonates, water-soluble salts of polycarboxylate polymers and copolymers, citric acid, and crystalline and amorphous sodium aluminosilicates.

13. A process for conditioning fabrics comprising the steps of:

(a) contacting the fabrics with an effective amount of an amine salt in the form of the fabric conditioning nodules of claim 1 and (b) subjecting the fabrics to a temperature within the range from about 40° C. to about 95° C.

14. A process for conditioning fabrics comprising the steps of:

(a) contacting the fabrics in a laundry wash or rinse liquor with an effective amount of an amine salt in the form of the fabric conditioning nodules of claim 3 and (b) causing the fabrics to tumble in relative motion to one another while being subjected to temperatures of from 50° C. to 95° C.

* * * * *